US009920466B2

(12) United States Patent
Brownlow

(10) Patent No.: US 9,920,466 B2
(45) Date of Patent: Mar. 20, 2018

(54) STRUCTURAL FOAM-CORE PANELS

(71) Applicant: Clarion Technologies, Inc., Holland, MI (US)

(72) Inventor: John Brownlow, Ada, MI (US)

(73) Assignee: Clarion Technologies, Inc., Holland, MI (US)

( * ) Notice: Subject to any disclaimer, the term of this patent is extended or adjusted under 35 U.S.C. 154(b) by 81 days.

(21) Appl. No.: 15/051,198

(22) Filed: Feb. 23, 2016

(65) Prior Publication Data

US 2016/0245580 A1 Aug. 25, 2016

Related U.S. Application Data

(60) Provisional application No. 62/120,325, filed on Feb. 24, 2015.

(51) Int. Cl.

| | |
|---|---|
| ***F25D 23/06*** | (2006.01) |
| ***D06F 37/28*** | (2006.01) |
| ***D06F 39/14*** | (2006.01) |
| ***F24C 15/02*** | (2006.01) |
| ***F25D 23/02*** | (2006.01) |

(52) U.S. Cl.
CPC ..... *D06F 37/28* (2013.01); *D06F 39/14* (2013.01); *F25D 23/02* (2013.01); *F25D 23/06* (2013.01)

(58) Field of Classification Search
None
See application file for complete search history.

(56) References Cited

U.S. PATENT DOCUMENTS

| | | | | |
|---|---|---|---|---|
| 3,164,880 | A | 1/1965 | Hotchkiss | |
| 3,283,386 | A | 11/1966 | Cenegy | |
| 3,406,229 | A | 10/1968 | Cenegy | |
| 3,541,747 | A | 11/1970 | Olson et al. | |
| 3,879,818 | A | 4/1975 | Rowland | |
| 3,927,788 | A | 12/1975 | Zinniger et al. | |
| 4,174,556 | A | 11/1979 | Richings | |
| 4,593,449 | A * | 6/1986 | Meray-Hovarth | .. B29C 44/1276 428/117 |
| 5,632,543 | A | 5/1997 | McGrath et al. | |
| 5,743,048 | A | 4/1998 | Kim | |
| 6,044,605 | A | 4/2000 | McDonald | |
| 6,161,363 | A | 12/2000 | Herbst | |
| 6,962,031 | B2 | 11/2005 | Clarke et al. | |
| 7,703,186 | B1 | 4/2010 | Williamson | |
| 7,721,501 | B2 | 5/2010 | Lynch et al. | |
| 8,291,556 | B2 | 10/2012 | Brownlow et al. | |
| 8,336,974 | B2 | 12/2012 | Lee et al. | |

(Continued)

*Primary Examiner* — David Sample
*Assistant Examiner* — Donald M Flores, Jr.
(74) *Attorney, Agent, or Firm* — Gardner, Linn, Burkhart & Ondersma LLP

(57) ABSTRACT

A panel for appliances includes an inner shell and an outer shell that engage one another to define a hollow interior region. An interior divider or intermediate close-out is disposed between the inner and outer shells, and has at least an outwardly-extending portion that extends into the hollow interior region. A foam core is bonded to interior surfaces of the shells and to the divider or close-out. The foam core may be formed or established by injecting an uncured or partially-cured liquid into the hollow interior region. Optionally, the panel is a movable door attached to an appliance, and may include a window portion in a central region thereof.

20 Claims, 11 Drawing Sheets

(56) References Cited

U.S. PATENT DOCUMENTS

| | | | | |
|---|---|---|---|---|
| 8,763,218 | B2 | 7/2014 | Brownlow et al. | |
| 2004/0003559 | A1 | 1/2004 | Minke et al. | |
| 2005/0034486 | A1* | 2/2005 | Bienick | F24C 15/04 68/3 R |
| 2005/0285490 | A1 | 12/2005 | Sibbett | |
| 2007/0145874 | A1 | 6/2007 | Lee et al. | |
| 2007/0181586 | A1 | 8/2007 | Van Ootmarsum et al. | |
| 2010/0218350 | A1 | 9/2010 | De La Fuente et al. | |
| 2011/0131921 | A1 | 6/2011 | Chen | |
| 2011/0146054 | A1 | 6/2011 | Selin et al. | |
| 2013/0076220 | A1* | 3/2013 | Yeom | D06F 39/14 312/326 |
| 2013/0086846 | A1 | 4/2013 | Lee et al. | |
| 2013/0099650 | A1 | 4/2013 | Lee et al. | |
| 2013/0255176 | A1 | 10/2013 | Roberts | |
| 2013/0256317 | A1 | 10/2013 | Roberts | |
| 2015/0102716 | A1 | 4/2015 | Cook | |

* cited by examiner

STRUCTURAL FOAM-CORE PANELS

CROSS REFERENCE TO RELATED APPLICATION

The present application claims the benefit of U.S. provisional application Ser. No. 62/120,325, filed Feb. 24, 2015, which is hereby incorporated herein by reference in its entirety.

FIELD OF THE INVENTION

The present invention relates to appliances and, more specifically, to panels and doors that form structural components including outer panels and doors of appliances.

BACKGROUND OF THE INVENTION

Panels and doors for appliances, including household appliances such as laundry washers and dryers, dishwashing machines, refrigerators and freezers, garbage compactors, and the like, are often made of at least two panels secured together with many mechanical fasteners. Therefore, such panels have many parts and require significant labor time to assemble.

SUMMARY OF THE INVENTION

The present invention provides a panel or door having inner and outer shells bonded together with a cured foam core, which may be particularly well suited for appliance doors or the like. The foam core may be injected as an uncured or partially-cured liquid into an interior hollow region defined between the inner and outer shells. The liquid may form a chemical bond with interior surfaces of the shells to rigidize the finished assembly, which may include a translucent or transparent viewing window in a middle region thereof. The panel or door has a reduced weight due to fewer wall sections and structural ribs, and has increased sound dampening qualities when compared to typical doors.

In one form of the present invention, a panel for appliances includes an inner shell and an outer shell, each with respective interior surfaces, an interior divider, and a foam core that is bonded to the interior divider and the interior surfaces of the inner and outer shells. The inner shell engages the inner shell, with the shells cooperating to define a hollow interior region in which the foam core is disposed. The interior divider is disposed between the interior surfaces of the inner shell and the outer shell, and includes a central portion and at least one outwardly-extending portion projecting into the hollow interior region defined between the inner and outer shells.

According to one aspect, at least one of the central portion and the outwardly-extending portion of the interior divider includes a divider surface that divides the foam core into at least two core portions on respective opposite sides thereof.

According to another aspect, the central portion of the interior divider defines a central opening. Optionally, the outwardly-extending portion of the interior divider includes a flange that is spaced from the interior surfaces of both the inner shell and the outer shell.

According to a further aspect, the outwardly-extending portion of the interior divider includes at least one dividing arm that spans from the interior surface of the inner shell to the interior surface of the outer shell. The dividing arm may include a distal end portion that extends outwardly into contact with an interior perimeter surface of at least one of the interior and exterior panels. Optionally, at least two of the dividing arms are provided, and cooperate to prevent an uncured foam material of the foam core from entering into a portion of the hollow interior region that is defined between the first and second dividing arms and the inner and outer shells.

According to yet another aspect, a central panel is provided, and is visible through a respective opening each of the inner shell, the outer shell, and the central portion of the interior divider. Optionally, the central panel is a translucent or transparent window.

According to still another aspect, the interior divider is unitarily formed with at least one of the inner shell, the outer shell, and the central panel or one translucent window.

According to a further aspect, a hinge is provided for pivotably coupling the panel to an appliance, and a latch piece is provided for releasably securing the panel in a closed position. Optionally, a hinge cover disposed in a hinge region of the hollow interior region and is securable to the hinge through the inner shell. The inner shell, the outer shell, and the interior divider cooperate to prevent an uncured foam material of the foam core from entering into the hinge region of the hollow interior region.

In another form of the present invention, a panel for appliances includes an inner shell and an outer shell, an intermediate close-out, a foam core, and inner and outer window panels. The inner and outer shells cooperate to define a hollow interior region that encircles an open central region. The intermediate close-out includes a central portion encircling the open central region, plus at least one outwardly-extending portion that extends into the hollow interior region between the inner and outer shells. The foam core is disposed in the hollow interior region, and is bonded to the inner shell, the outer shell, and the intermediate close-out. The inner window panel is associated with the inner shell and the outer window panel is associated with the outer shell, with the inner and outer window panels being disposed in the central region. The intermediate close-out cooperates with the inner and outer shells to divide the foam core into separate portions within the hollow interior region.

Thus, the structural foam core panel may be used as a wall panel or door, including for appliances and/or in environments where moisture is present, which is moisture-resistant, has relatively few parts and may be lighter weight than conventional panels or doors, provides sounds and thermal insulation, and may be comparably or at least as strong and rigid as panels and doors built using more conventional methods. Reduced parts-count and faster assembly times also reduce production costs and, depending on the configuration, may not require any specialized clamps or fixtures during a curing process for the foam core that is typically injected in an uncured or semi-cured, liquid or flowable state.

These and other objects, advantages, purposes and features of the present invention will become apparent upon review of the following specification in conjunction with the drawings.

DESCRIPTION OF THE PREFERRED EMBODIMENTS

Figure 1:
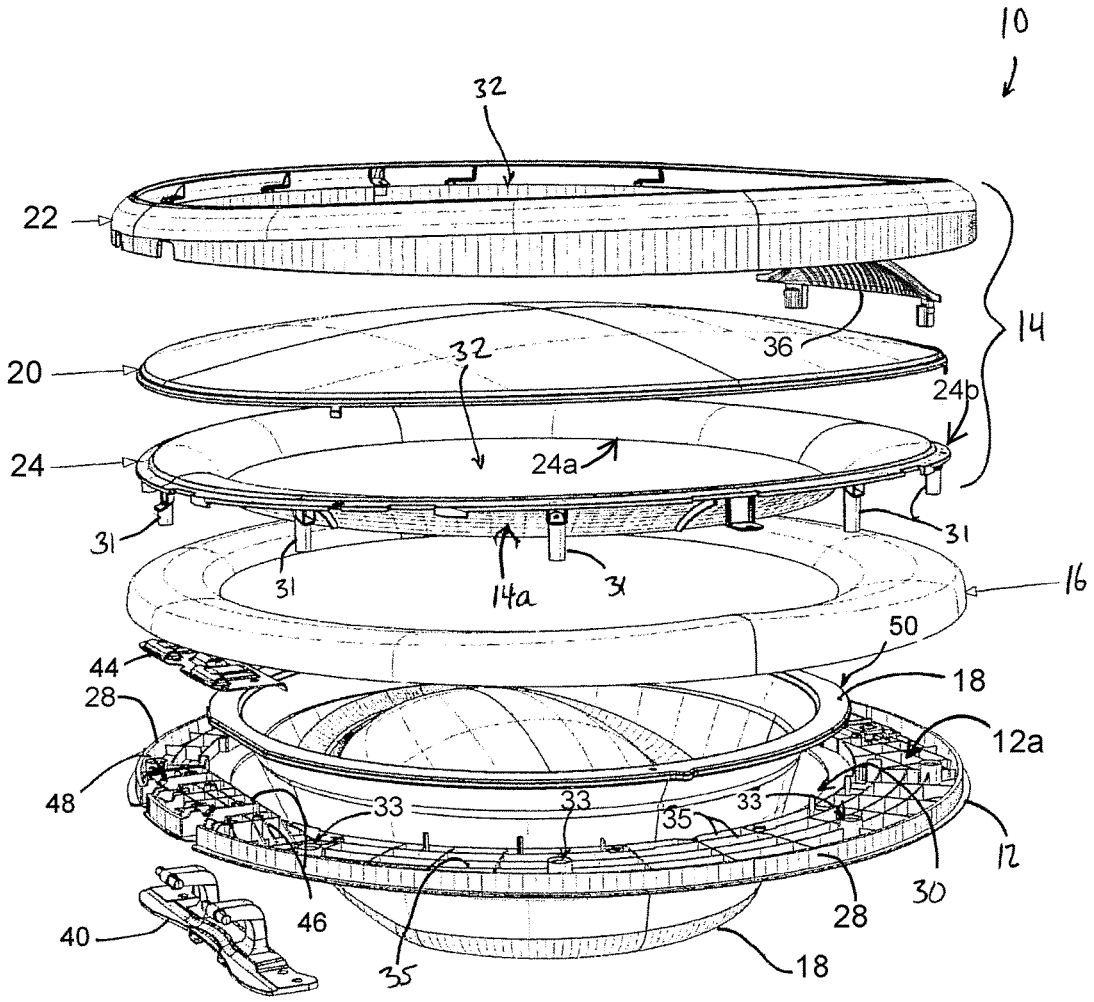
FIG. 1 is an exploded perspective view of a laundry machine door with structural foam in accordance with a first embodiment the present invention.
Figure 2:
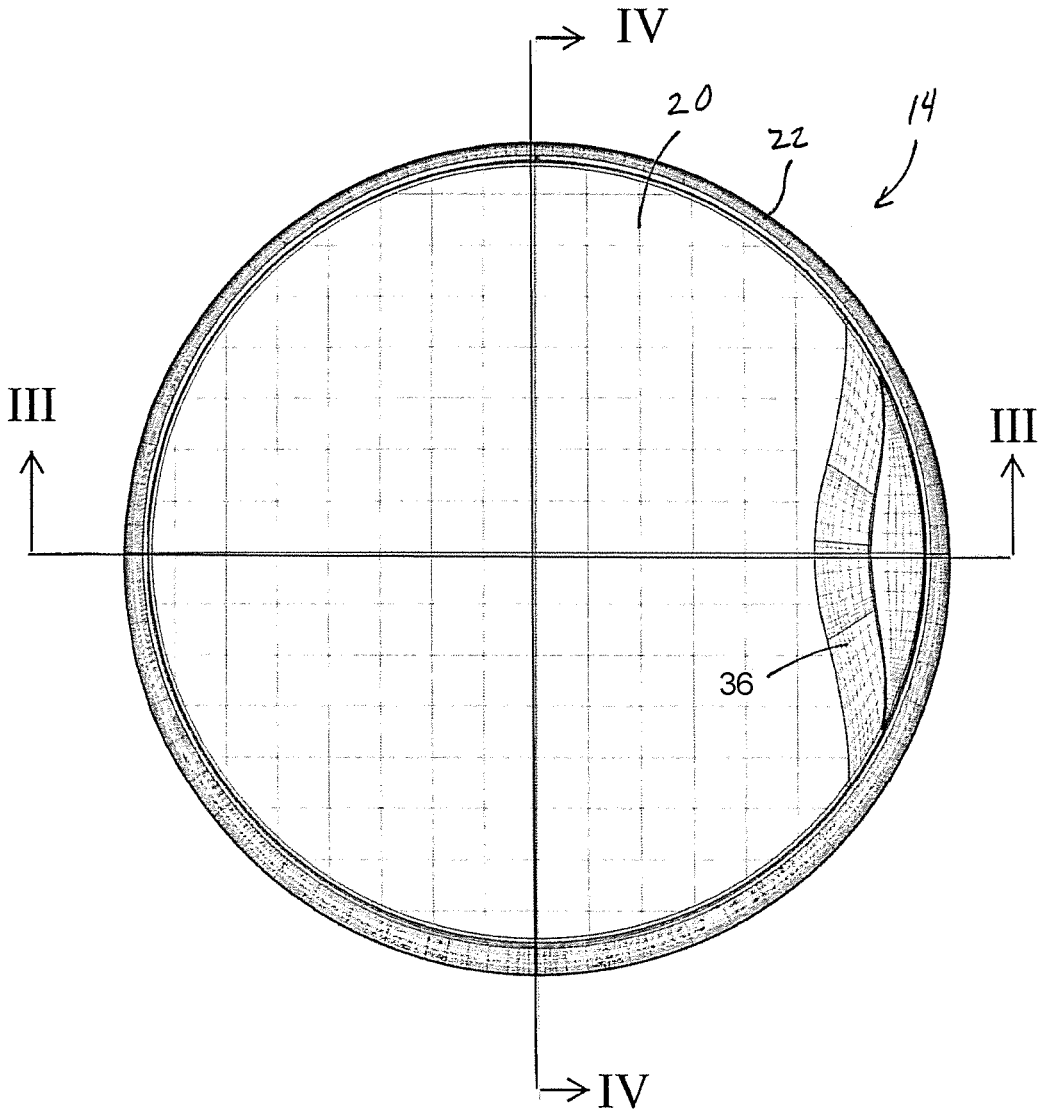
FIG. 2 is front elevation of the laundry machine door of FIG. 1.

Referring now to the drawings and the illustrative embodiments depicted therein, a panel in the form of a door 10 for appliances includes an inner shell 12, an outer shell 14, and a foam core 16 (FIG. 1). In the embodiment of FIGS. 1-4, door 10 is a laundry washing machine door having an inner window panel 18 that mates with inner shell 12 and an outer window panel 20 that forms a central region of outer shell 14. Outer shell 14 is an assembly made up of outer window panel 20, an outermost shell piece 22, and an intermediate shell piece 24, such as shown in FIG. 1. Outer shell 14 and inner shell 12 are configured to engage one another to define a hollow interior region 26 (FIGS. 3 and 4) between respective interior surfaces 12*a*, 14*a* of inner shell 12 and outer shell 14. Foam core 16 is disposed in hollow interior region 26 and forms a structural part of door 10 by bonding with interior surfaces 12*a*, 14*a* during a curing process, as will be described in more detail below. Intermediate shell piece 24 may function as an interior divider or a partial close-out element for the foam core 16 and hollow interior region 26, as will also be described in more detail below.

Optionally, one of the inner shell 12 and the outer shell 14 includes a perimeter ridge, such as perimeter ridge 28 of inner shell 12, and the other of the inner shell and the outer shell includes a perimeter groove. The groove and ridge cooperate as a tongue-in-groove arrangement whereby the groove receives the perimeter ridge and establishes a seal against uncured foam exiting the hollow interior region during an expansion and curing process or reaction.

Figure 3:
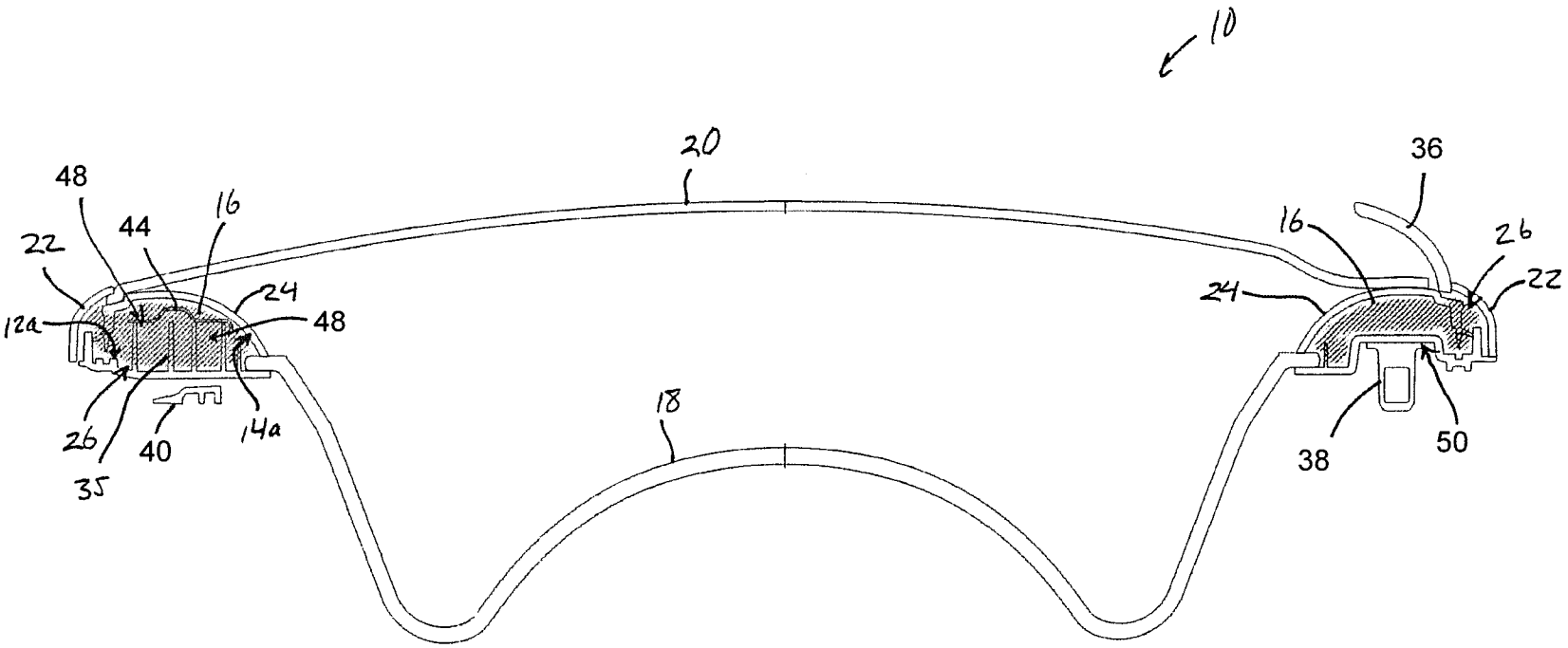
FIG. 3 is a bottom sectional view of the laundry machine door, taken along section line III-III in FIG. 2.
Figure 4:
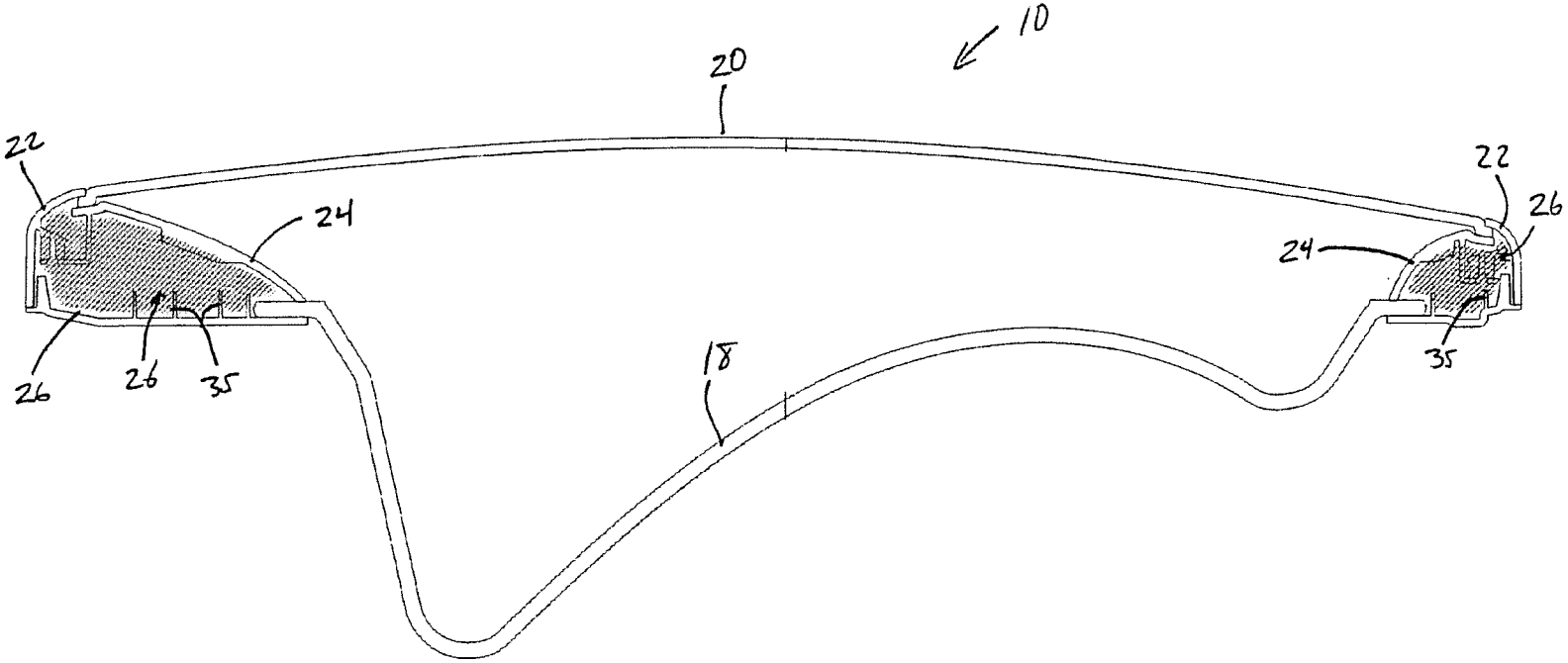
FIG. 4 is a side sectional view of the laundry machine door, taken along section line IV-IV in FIG. 2.
Figure 5:
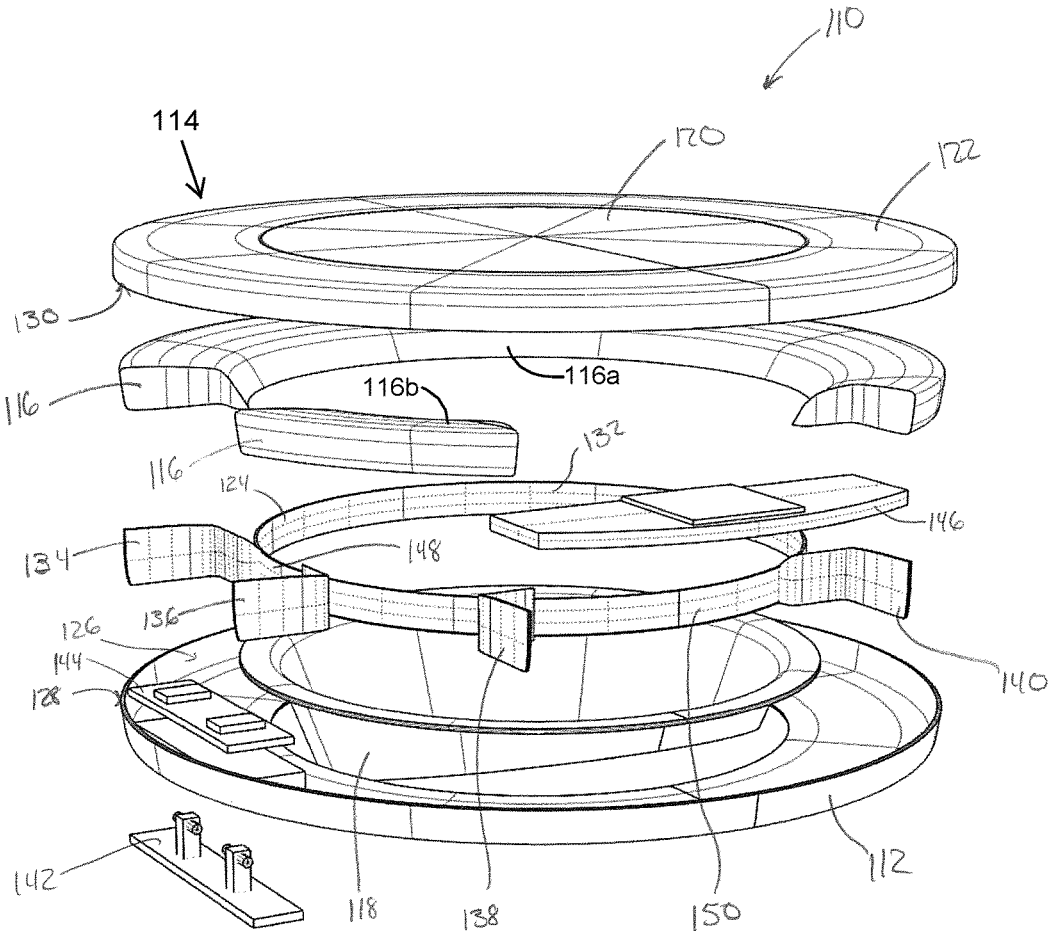
FIG. 5 is an exploded perspective view of a laundry machine door with structural foam in accordance with a second embodiment of the present invention.
Figure 6:
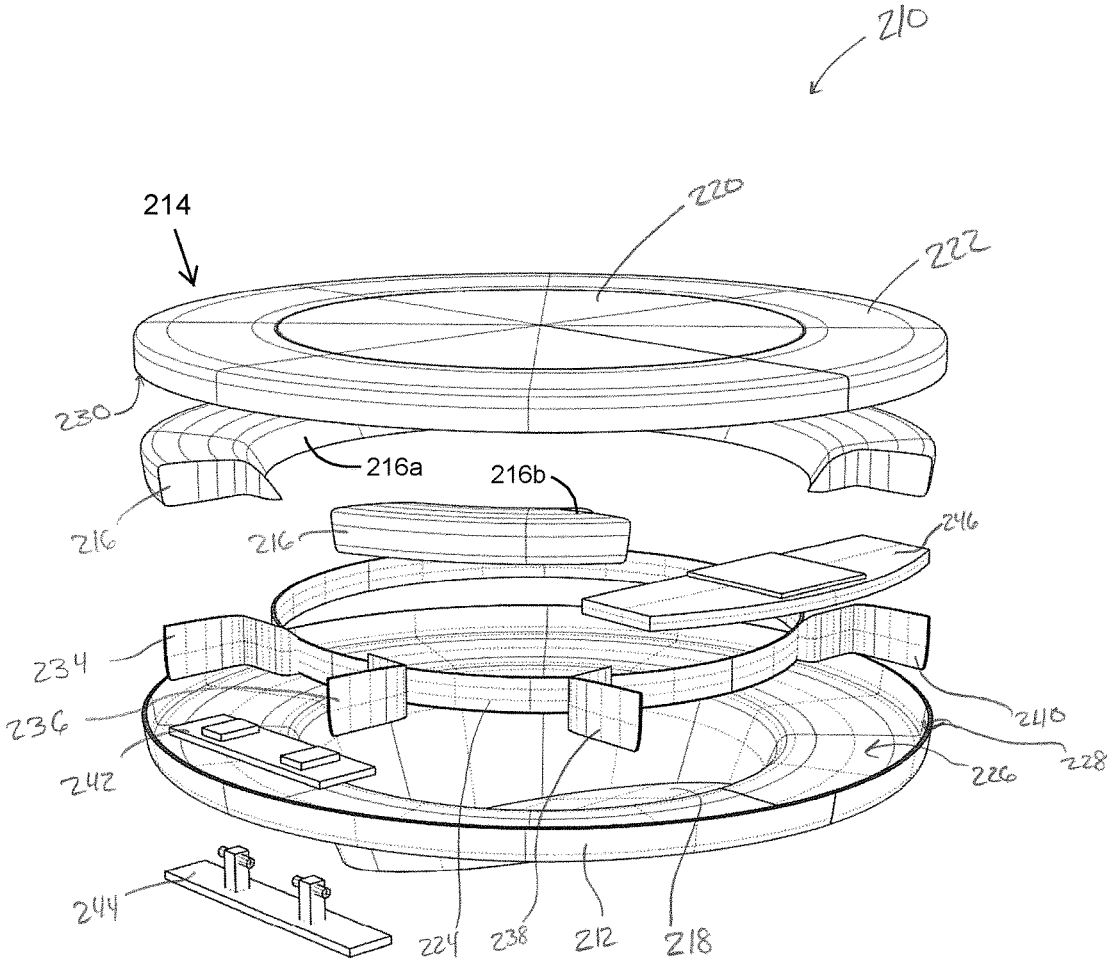
FIG. 6 is an exploded perspective view of a laundry machine door with structural foam in accordance with a third embodiment of the present invention.

Inner shell 12 and outer shell 14 define respective openings 30, 32 for receiving and/or providing visibility through respective ones of the inner window panel 18 and outer window panel 20. Inner and outer window panels 18, 20 may be translucent or transparent panels made of resinous plastic, glass, or the like, and may be sealed to the inner and outer shells 12, 14, respectively, to prevent intrusion of water or other contaminants. However, it will be appreciated that each shell may be substantially continuous with no provisions made for a central panel or window, without departing from the spirit and scope of the present invention. Intermediate shell piece 24 includes a central portion 24*a* and an outwardly-extending portion 24*b* that projects into the hollow interior region 26 and is spaced between the interior surfaces of the inner shell 12 and the outermost shell piece 22. Outwardly-extending portion 24*b* is shaped as a flange that has outermost portions that may act as divider surfaces to partially divide portions of the foam core 16 into at least two core portions or regions on respective opposite sides of the outwardly-extending portion 24*b*, such as shown in FIGS. 3 and 4. Optionally, and as shown in FIG. 1, intermediate shell piece 24 includes a plurality of locating fingers or projections 34 that engage respective openings or bores 33 formed along interior surface 12*a* of inner shell 12 during assembly, to facilitate and maintain proper alignment of outer shell 14 relative to inner shell 12 during injection, expansion, and curing of liquid foam that forms foam core 16. Outer shell 14 may also be formed with stiffening ribs along interior surface 14*a* of intermediate shell piece 24. Adhesives may also be used to secure components of the panel during the injection, expansion, and curing.

Foam core 16 may be injected into hollow interior region 26 as an uncured or partially-cured liquid or resinous material, such as a thermoset urethane foam that is applied or injected in a liquid or semi-liquid state (such as a liquid resin), and which forms bubbles and expands as it cures. The liquid foam or resin is injected into the hollow interior region 26 via one or more injection openings formed in inner shell 12. It will be appreciated that the foam could be injected through substantially any opening formed in an outer surface of panel 10, or could be applied (such as by spraying or pouring) to interior surfaces 12*a* and/or 14*a* prior to assembling the inner and outer shells together. The shells 12, 14 may be held or clamped in a fixture to apply pressure to the panel while uncured foam is injected into the hollow interior region 26 through one or more holes or openings, and also during an expansion phase of the foam curing process (which may last about 30 seconds to 60 seconds, or more or less than that), to limit or prevent undesired separation of the shells from one another during curing.

The materials selected for shells 12, 14 and for foam core 16 are preferably such that foam core 16 forms a chemical bond with the respective inner surfaces 12*a*, 14*a* of inner and outer shells 12, 14 and then hardens during the final curing stage, to form a substantially rigidized assembly. It is envisioned that the bond may be sufficient to securing the shells together without need for any mechanical fasteners such as screws or the like, or at least reducing the need or desirability of using separate mechanical fasteners. Optionally, and as shown in FIG. 1, the interior surface 12*a* of inner shell 12 includes a plurality of ribs 35 that provide stiffening for shells 12, and that provide additional surface area to which foam core 16 will chemically bond, which provides further stiffening and rigidity for the finished panel 10.

When panel 10 is configured as a movable door, as shown in the accompanying drawings, outer shell 14 is fitted with a handle 36 to aid a user in grasping and pulling the door open (FIGS. 1 and 3). A latch piece 38 (FIG. 3) projects rearwardly from inner shell 12 and engages a corresponding latch piece of the appliance (not shown) to which door 10 is attached. Located opposite handle 36 is a hinge member 40 that is coupled to outer shell 14 and/or inner shell 14, and that is configured for attachment to the appliance. Hinge member 40 permits door 10 to pivot relative to the appliance, and latch piece 38 (cooperating with the corresponding latch piece of the appliance) selectively retains door 10 in a closed position.

Hinge member 40 is mounted at a hinge-receiving region 48 that may be substantially sealed off from hollow interior region 26, to thereby limit or prevent foam from intruding and interfering with operation of hinge member 40, and to facilitate servicing or replacement of hinge member 40 as desired. For example, an inner hinge cover 44 may be provided to cooperate with baffles 46 having additional height for closing off hinge-receiving region 48, such as shown in FIGS. 1 and 3. A latch-receiving region 50 may be configured similarly to hinge-receiving region 48. Hinge member 40 and latch piece 38 may be secured in place using threaded fasteners, adhesives, resilient snap-latching connectors, or the like.

Although panel 10 is shown and described herein as a pivotably mounted door for an appliance, it will be appreciated that other applications are available, such as structural panels forming an outer casing or housing of an appliance or similar device. It will further be appreciated that, in addition to providing both structural rigidity and fastening or securing of inner shell 12 to outer shell 14, foam core 16 also provides sealing against moisture and air leaks (particularly when in the form of a closed-cell foam), thereby limiting or preventing the formation of mold, and also provides thermal insulation. It is further envisioned that the foam core may be cast or formed in another manner as a solid piece, and then bonded to the interior surfaces of the inner and outer shells using adhesives or the like.

In embodiments having one or more central panels or windows, one of the inner shell 12 and the outer shell 14 may include an inner perimeter ridge disposed around the respective opening 30, 32, while the other of the inner shell 12 and the outer shell 14 includes an inner perimeter groove disposed around the respective opening 30, 32. The inner perimeter groove is configured to receive the inner perimeter ridge and thereby establish a seal against uncured foam exiting the hollow interior region 26 during curing. However, it is also envisioned that each panel or window may be sealed to its respective shell via an adhesive and/or sealant, for example.

Various alternative designs are envisioned, which reduce the number of components, and/or simplify the various components used, and/or simplify the assembly process for doors or panels in accordance with the present invention, as will now be described with reference to FIGS. 5-11. For example, in a second embodiment of the structural foam core panels, shown in FIG. 5, another panel or door 110 is assembled from seven components plus an injected foam core. In the illustrated embodiment of FIG. 5, door 110 is configured for hinged attachment to appliances, such as a laundry washing machine, and its primary components include an inner shell 112, an outer shell 114, and a foam core 116. An inner window panel 118 mates with inner shell 112, and an outer window panel 120 is seated in an open central region of outer shell 114. When outer shell 114 and inner shell 112 are assembled together, they define a generally annular hollow interior region 126 in which a separate interior divider or close-out element 124 and an injected foam core 116 are received. Once cured, foam core 116 forms a structural part of door 110 by bonding with interior surfaces during a curing process, as will be understood with reference to the above description of the first embodiment door 10. However, unlike the foam core 16 of the first door 10, foam core 116 of the second door 110 is formed as two isolated sections 116*a*, 116*b*, as will be described below.

The inner shell 112 and the outer shell 114 include respective perimeter walls or ridges 128, 130 that fit tightly together upon assembly, to thereby establish a seal against uncured foam exiting the hollow interior region 126 during an expansion and curing process or reaction. Optionally, one of the perimeter walls 128, 130 may be configured as a double wall in which a groove is formed between two closely-spaced wall portions, wherein the groove as a width that substantially corresponds to the thickness of the other shell's perimeter wall, so that the double wall of one shell receives (in its groove) the single wall of the other shell in a tongue-in-groove arrangement, which may further enhance a seal against uncured foam resin escaping the hollow interior region 126 during expansion and curing of the foam.

The interior region 126 is further defined and divided by the close-out element 124, which includes an annular central portion 132 and a plurality of dividing arms 134, 136, 138, 140 that both register the close-out element in a desired orientation that is centered along an interior of inner shell 12, and act as baffles as liquid resinous foam is injected and cures. The close-out element 124 may be formed of different materials, such as metals, plastics, or composites, depending on the required structural properties. The close-out element's central portion 132 encircles the inner window panel 118 and mates with the inner shell 112 and inner window panel 118 and/or outer shell 114. Each dividing arm 134, 136, 138, 140 extends from the central portion 132 to the perimeter ridge 128 of the inner shell 112, and has a height that extends from the inner shell 112 to the outermost shell piece 122 of the outer shell 114. Each of the dividing arms 134, 136, 138, 140 extends outwardly from the central portion 132 and has a respective distal end portion that terminates at the perimeter ridge 130 of the inner shell 112. Dividing arms 134, 136, 138, 140 may have angled shapes as shown, or may have substantially linear or arcuate shapes, or may be formed with a combination of shapes.

The dividing arms 134, 136, 138, 140 are configured to substantially restrict foam and resin from traversing past each respective dividing arm, thus permitting foam to be injected into certain desired portions of the hollow interior region 126, forming a separate first foam section 116*a* and a separate second foam section 116*b* that would be injected separately, while optionally leaving other portions of the hollow interior region open and substantially free of foam, such as in the vicinity of a hinge member 142 and hinge cover 144, and an optional electronics board 146. For example, the hinge member 142 and hinge cover are substantially surrounded by dividing arms 134 and 136, a portion 148 of the annular central portion 132, the perimeter ridge 128 of the inner shell, the inner shell 112, and the outer shell 114. Thus, the close-out element 124 cooperates with the inner shell 112 and outer shell 114 to substantially limit or prevent foam from contacting the hinge member 142 and hinge cover 144. Likewise, the electronics board 146 is enclosed by dividing arms 138 and 140, a portion 150 of the central portion 132, the perimeter ridge 128 of the inner shell, the inner shell 112, and the outer shell 114.

In addition to the separate close-out element 124 of the second door 110, it is envisioned that close-out elements and/or other components may be combined or unitarily formed to further reduced the parts-count for a given structural form core door or panel. For example, and with reference to FIG. 6, a third embodiment structural foam core panel or door 210 is similar to the second embodiment door 110 described above, except that second door 210 includes an inner shell 212 with an integrally-formed inner window panel 218, rather than separate inner shell and inner window panel. The other regions and components of the third embodiment door 210 are substantially similar or identical to regions and components of the second embodiment door 110, described above, and are given like numerals by the addition of 100, such that the various regions and components of the third embodiment door 210 will be readily understood with reference to FIG. 6 and the above discussion of the second embodiment door 110.

Figure 7:
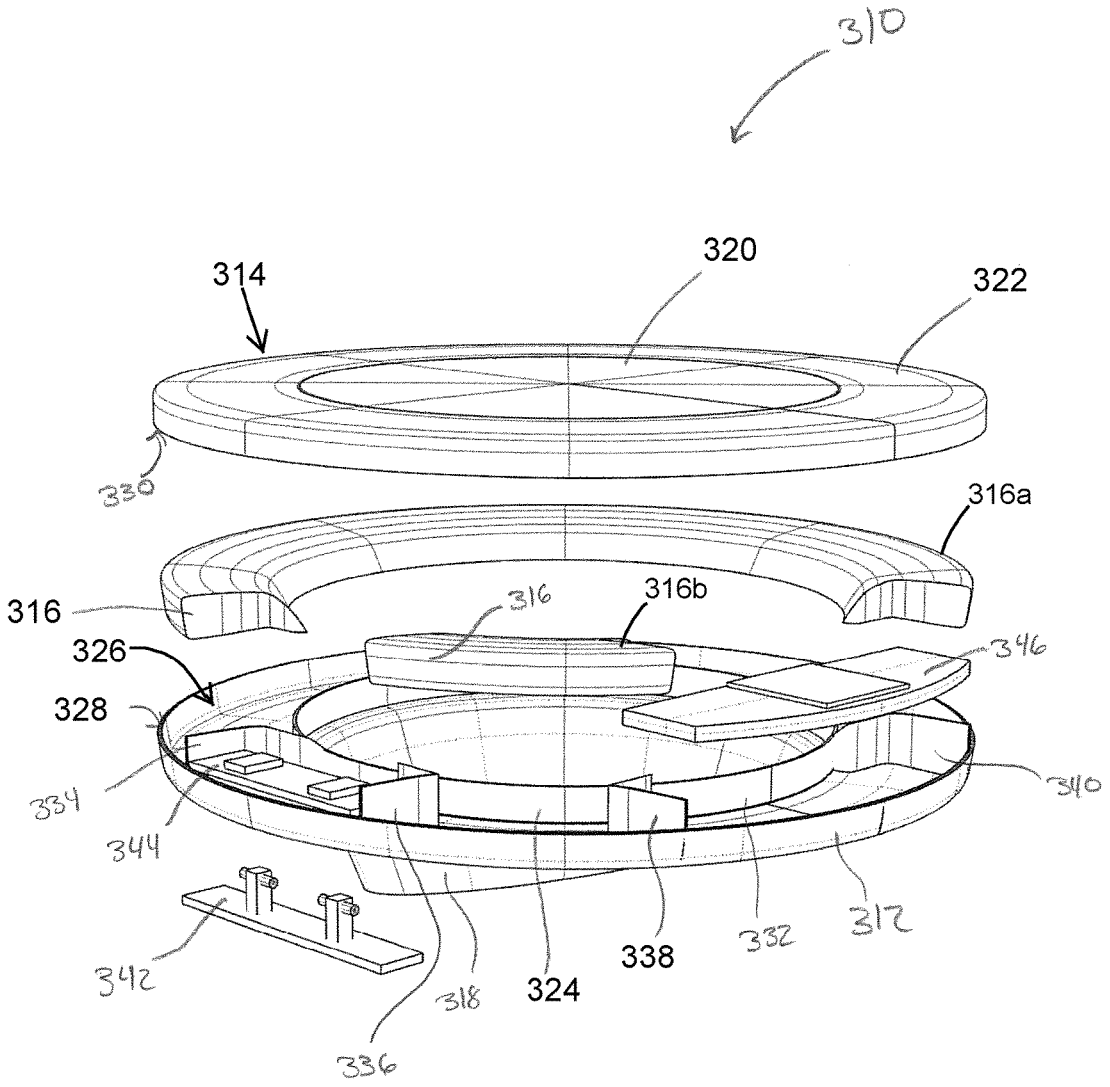
FIG. 7 is an exploded perspective view of a laundry machine door with structural foam in accordance with a fourth embodiment of the present invention.

A fourth embodiment structural foam core panel or door 310 is illustrated in FIG. 7. The fourth embodiment door 310 is similar to the second and third embodiment doors 110, 210 described above, except that fourth door 310 includes an inner shell 312 with an integrally or unitarily-formed inner window panel 318, and also with an integrally or unitarily-formed interior divider or close-out element 324. Thus, inner shell 312, inner window panel 318, and close-out element 324 are formed as a single unit, rather than as two units (as in third door 210) or as three units (as in second door 110). The other regions and components of the fourth embodiment door 310 are substantially similar or identical to regions and components of the second embodiment door 110, described above, and are given like numerals by the addition of 200, such that the various regions and components of the fourth embodiment door 310 will be readily understood with reference to FIG. 7 and the above discussion of the second embodiment door 110.

Figure 8:
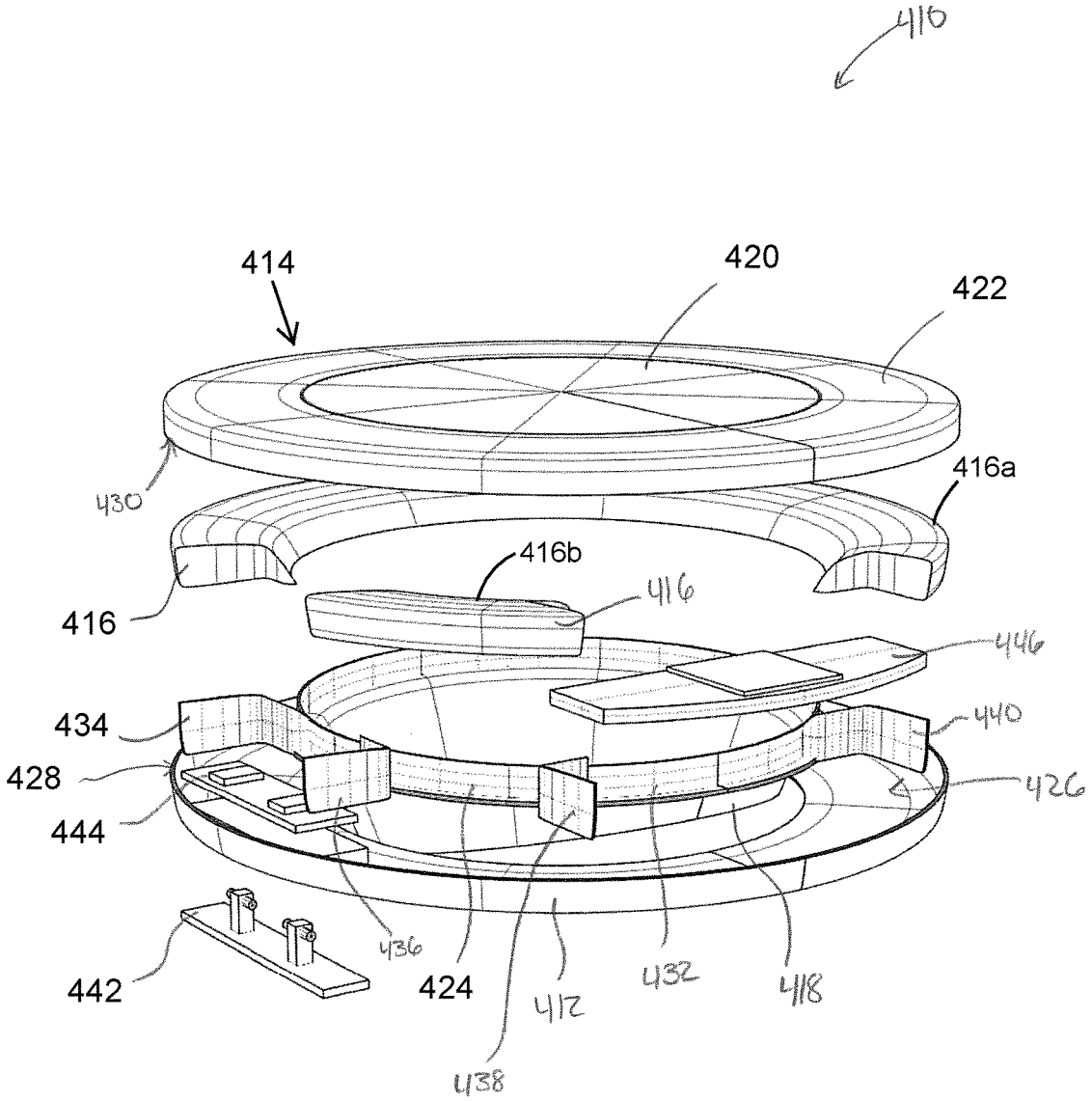
FIG. 8 is an exploded perspective view of a laundry machine door with structural foam in accordance with a fifth embodiment of the present invention.

A fifth embodiment structural foam core panel or door 410 is illustrated in FIG. 8, in which an inner window panel 418 is integrally or unitarily formed with an interior divider or close-out element 424, which are then assembled as a unit to an inner shell 412. Thus, inner window panel 418, and close-out element 424 are formed as a single unit, rather than as two units (as in second door 110). The other regions and components of the fifth embodiment door 410 are substantially similar or identical to regions and components of the second embodiment door 110, described above, and are given like numerals by the addition of 300, such that the various regions and components of the fifth embodiment door 410 will be readily understood with reference to FIG. 8 and the above discussion of the second embodiment door 110.

Figure 9:
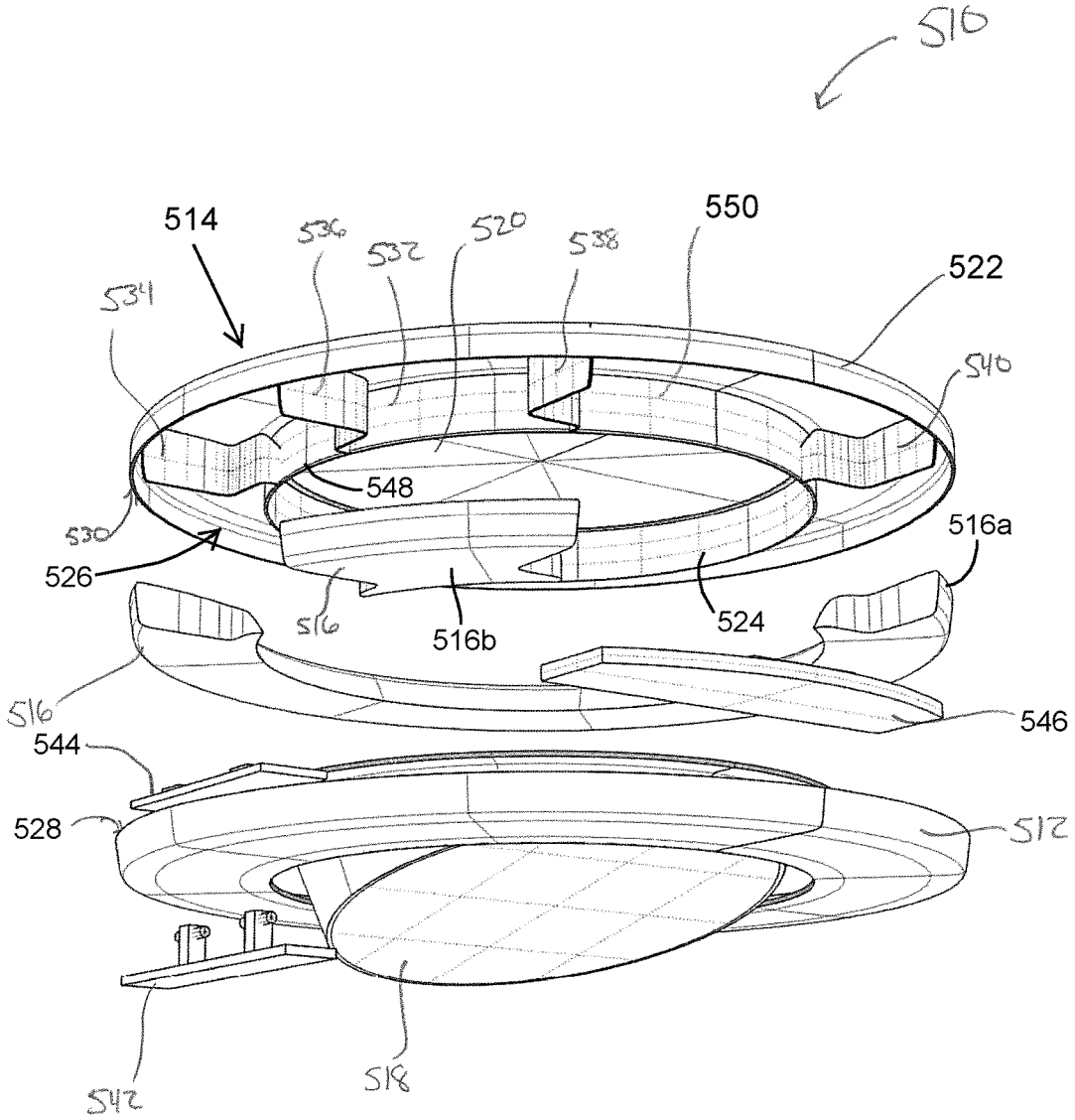
FIG. 9 is an exploded perspective view of a laundry machine door with structural foam in accordance with a sixth embodiment of the present invention.

A sixth embodiment structural foam core panel or door 510 is illustrated in FIG. 9, in which an outer shell 514 is integrally or unitarily formed with an interior divider or close-out element 524. Thus, outer shell 514 and close-out element 524 are formed as a single unit, rather than as two units (as in second door 110). The other regions and components of the sixth embodiment door 510 are substantially similar or identical to regions and components of the second embodiment door 110, described above, and are given like numerals by the addition of 400, such that the various regions and components of the sixth embodiment door 510 will be readily understood with reference to FIG. 9 and the above discussion of the second embodiment door 110.

Figure 10:
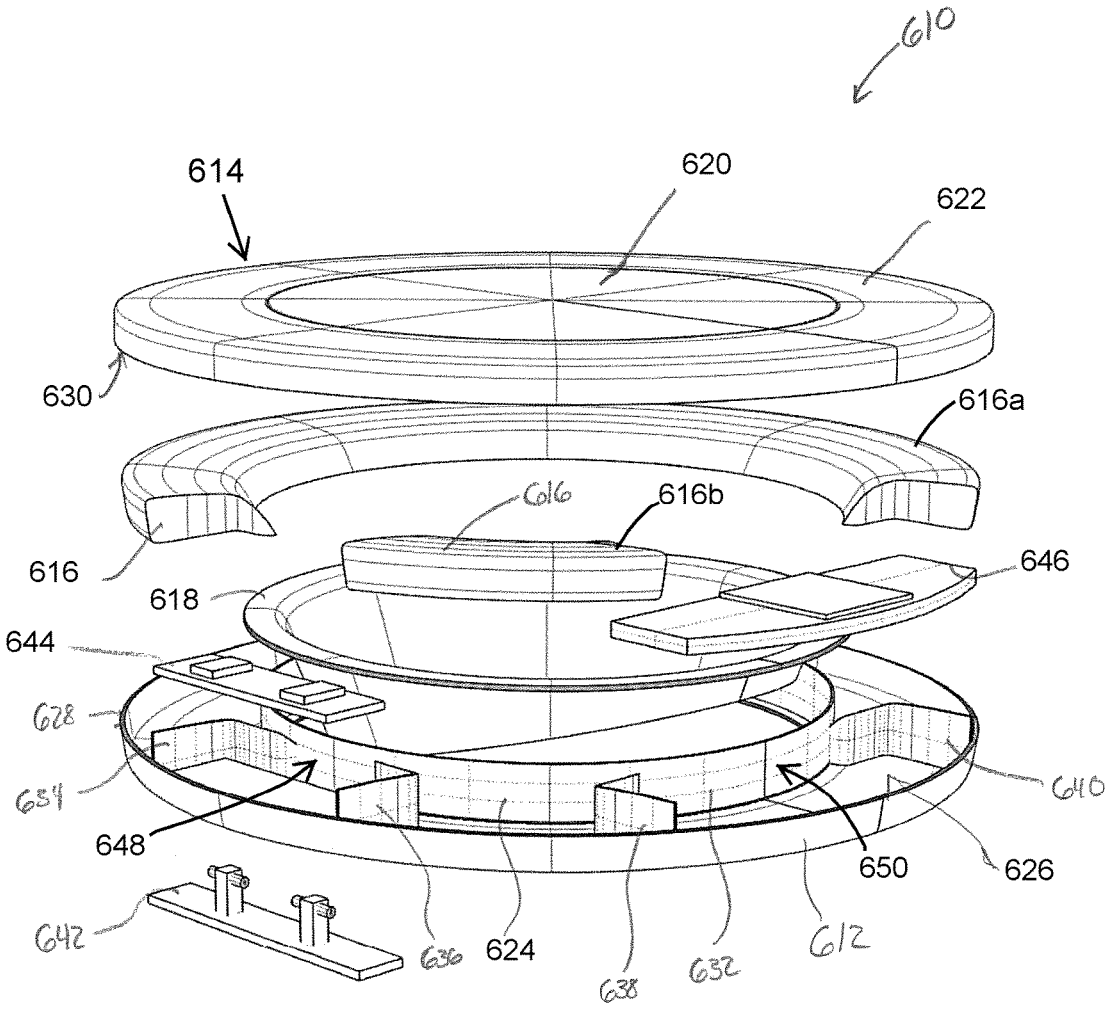
FIG. 10 is an exploded perspective view of a laundry machine door with structural foam in accordance with a seventh embodiment of the present invention.

A seventh embodiment structural foam core panel or door 610 is illustrated in FIG. 10, in which an inner shell 612 is integrally or unitarily formed with an interior divider or close-out element 624. A separate inner window panel 620 is received and sealed into an opening formed by the one-piece inner shell 612 with integrated close-out element 624. The other regions and components of the seventh embodiment door 610 are substantially similar or identical to regions and components of the second embodiment door 110, described above, and are given like numerals by the addition of 500, such that the various regions and components of the seventh embodiment door 610 will be readily understood with reference to FIG. 10 and the above discussion of the second embodiment door 110.

Figure 11:
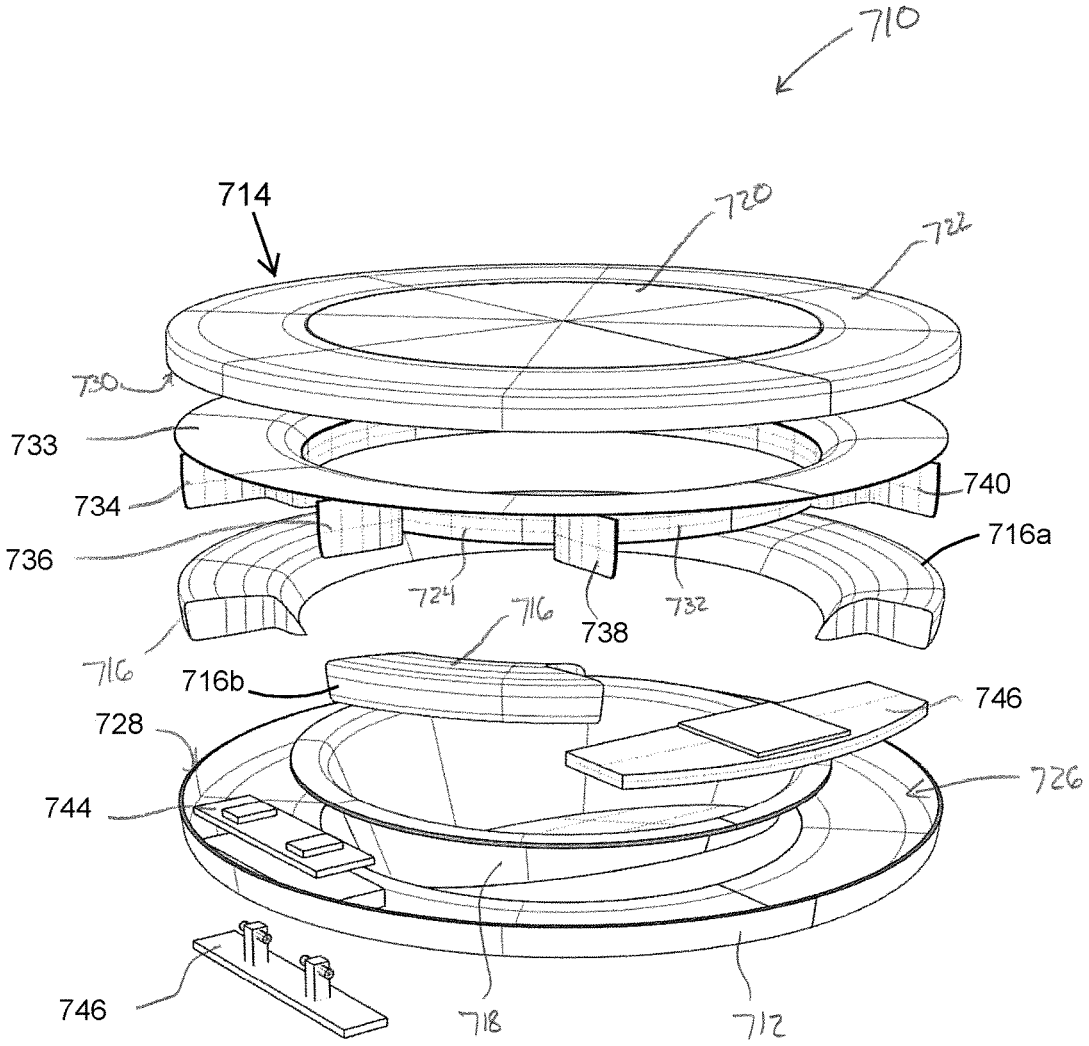
FIG. 11 is an exploded perspective view of a laundry machine door with structural foam in accordance with an eighth embodiment of the present invention.

An eighth embodiment structural foam core panel or door 710 is illustrated in FIG. 11, in which an outer shell assembly 714 is formed as a two-piece assembly of an outer shell piece 722 and a separate race ring 733 that is integrally or unitarily formed with an interior divider or close-out element 724. An outer window panel 720 may be assembled separately to outer shell piece 722, or may be integrally or unitarily formed therewith. The other regions and components of the eighth embodiment door 710 are substantially similar or identical to regions and components of the second embodiment door 110, described above, and are given like numerals by the addition of 600, such that the various regions and components of the eighth embodiment door 710 will be readily understood with reference to FIG. 11 and the above discussion of the second embodiment door 110.

As shown in FIGS. 5-11, each of the second through eighth embodiments of panels or doors disclosed herein has substantially smooth inner surfaces of the inner and outer panels, rather than the use of ribs or ribbing 35 along the interior surfaces of the inner and outer shells 12, 14 of the first embodiment 10. By omitting the ribbing from the inner and outer shells or shell pieces of the later embodiments, the complexity and cost of molds used for injection molding of the inner and outer shells can be reduced considerably, and the resulting shells also have reduced material cost and weight compared to shells that are formed with extensive ribbing. Although the use of ribbing does have benefits such as stiffening and additional surface area with which a foam core can chemically bond, and it is envisioned that the designs for the shells or shell pieces of the second through eighth embodiments could be readily modified to include ribbing, it will be appreciated that the cost and weight reductions that are realized by omitting the ribbing may justify such omission, particularly when the finished doors and panels readily meet design targets for weight, strength, and stiffness without such ribbing. Thus, the use of ribs or ribbing is considered optional, and may be incorporated into a given door design for certain applications in which higher weight and cost are justifiable to achieve greater strength and rigidity.

In addition, it will be appreciated that designs that utilize unitary construction of different components, particularly different components having different functions, those components may be formed using a so-called "two-shot" (or "three-shot", etc.) injection molding method, for example. Thus, the third embodiment door 210 of FIG. 5 can have its combined inner shell 212 and inner window 218 formed in a single two-shot injection molding process in which a transparent or translucent material is injected to form inner window 218 and an opaque material is injected to form the inner shell 212. The opaque material and inner window material fuse together while they are in liquid form, and harden or cure to form the one-piece combined inner shell 212 and inner window 218. The same or similar techniques may be used to unitarily or integrally form the close-out element with the inner or outer shell, or with one of the window panels. The ability to mold two or more different materials simultaneously into a unitary component allows different material properties to be incorporated into a one-piece component, which material properties may include color, translucence, flexibility, etc. This facilitates meeting structural design requirements while still achieving the benefits of reduced parts count, and can be used to enhance the ability of one component to form a foam-tight seal to thereby prevent undesired seepage or intrusion of foam into undesired areas during the curing process.

Other design features that may be incorporated into any one or more of the above-described embodiments include structural elements that reduce or eliminate any need for a clamping fixture to hold the shell pieces together during an expansion/curing phase of the injected foam. For example, the inner and outer shells may be designed with twist-lock features that cooperate to securely hold the inner and outer shells together during the foam expansion/curing phase. Such twist-lock features may include, for example, a plurality of pins or projections with enlarged head or tip portions along one of the shells, which head or tip portions are received in respective keyhole slots formed in the other shell and secure the shells together when they are rotated relative to one another until the twist-lock features are fully engaged. Alternative design features for securing the shell pieces together during a foam expansion/curing phase include resilient snap-fit tabs and/or slots that engage and lock together once the inner and outer shells are fully seated, or a slide-interference arrangement in which surfaces of each shell piece tightly engage (e.g., through an interference fit) when pressed together, or that form an interference fit only upon rotation of one shell relative to another (e.g., utilizing arcuate wall surfaces that change thickness in a circumferential direction).

It is further envisioned that an adhesive and/or sealant material may be applied to surfaces of the inner and/or outer shells prior to assembly and prior to injecting uncured foam, which adhesive and/or sealant material can both secure the shell pieces together prior to injecting the uncured foam, and can establish or enhance the seals formed between corresponding surfaces or surface portions of the shell pieces, thereby reducing or eliminating places where expanding foam could seep out. It will be appreciated that screws or other mechanical fasteners could be used to secure the inner and outer shells together prior to injecting the uncured foam. However, the use of adhesives, sealants, and separate mechanical fasteners may be less desirable than some of the alternatives described above because they require additional materials and/or manufacturing steps, and thus may increase the cost and manufacturing time.

Although each of the doors shown and described herein is formed as generally round or circular appliance doors, such as for use with a laundry washing or drying machine, it will be appreciated that the doors or panels may be formed in substantially any round or rounded shape, or in a polygon such as a square or rectangle, and may be formed with or without translucent windows, without departing from the spirit and scope of the present invention.

Accordingly, the present invention provides structurally rigid appliance panels or doors having few separate mechanical fasteners (or none at all), which panels or doors are substantially sealed against contaminants including moisture that could otherwise lead to the formation of mold, and which can be assembled quickly due to reduced parts count and substantial lack of fasteners. Stiffness and rigidity are enhanced by the foam bonding to substantially all surfaces that it contacts, as compared to a discrete number of mechanical fasteners that only secure at localized areas. The resulting panel or door may also be made substantially flame resistant, meeting one or more of Underwriters Laboratories' (UL's) V-0, V-1, V-2, V-3, V-4, and V-5 flammability ratings. The panel or door has a reduced weight due to fewer wall sections and structural ribs, which is made possible through the use of foam as a bonding agent, a structural member, a seal, and a thermal and sound insulator.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A panel for appliances, said panel comprising:

an inner shell and an outer shell configured to engage said inner shell, wherein said inner shell and said outer shell have respective interior surfaces that cooperate to define a hollow interior region;

an interior divider disposed between said interior surfaces of said inner shell and said outer shell, said interior divider including a central portion and at least one outwardly-extending portion projecting into said hollow interior region, wherein said outwardly-extending portion of said interior divider comprises at least one dividing arm that spans from said interior surface of said inner shell to said interior surface of said outer shell; and a foam core disposed in said hollow interior region, wherein said foam core is bonded to said interior surfaces of both said inner shell and said outer shell, and to at least a portion of said interior divider;

wherein at least one of said central portion and said outwardly-extending portion of said interior divider comprises a divider surface configured to divide said foam core into at least two core portions on respective opposite sides of said divider surface.

2. The panel of claim 1, wherein said central portion of said interior divider defines a central opening.

3. The panel of claim 1, wherein said at least one dividing arm comprises a distal end portion that extends outwardly into contact with an interior perimeter surface of at least one of said interior and exterior panels.

4. The panel of claim 3, wherein said at least one dividing arm comprises a first dividing arm and a second dividing arm, and wherein said first and second dividing arms are configured to prevent an uncured foam material of said foam core from entering into a portion of said hollow interior region that is defined between said first and second dividing arms and said inner and outer shells.

5. The panel of claim 4, wherein said central portion of said interior divider defines a central opening.

6. The panel of claim 1, further comprising a central panel, wherein each of said inner shell, said outer shell, and said central portion of said interior divider defines a respective opening through which said central panel is visible.

7. The panel of claim 6, wherein said central panel comprises at least one translucent window.

8. The panel of claim 7, wherein said interior divider is unitarily formed with at least one of said inner shell, said outer shell, and said at least one translucent window.

9. The panel of claim 1, further comprising a hinge for pivotably coupling said panel to an appliance, and a latch piece for releasably securing said panel in a closed position, wherein each of said hinge and said latch piece are coupled to said inner shell.

10. The panel of claim 9, further comprising a hinge cover disposed in a hinge region of said hollow interior region and securable to said hinge through said inner shell, wherein said inner shell, said outer shell, and said interior divider cooperate to prevent an uncured foam material of said foam core from entering into said hinge region of said hollow interior region.

11. A panel for appliances, said panel comprising:

an inner shell and an outer shell configured to engage said inner shell, wherein said inner shell and said outer shell have respective interior surfaces that cooperate to define a hollow interior region;

an interior divider disposed between said interior surfaces of said inner shell and said outer shell, said interior divider including a central portion and at least one outwardly-extending portion projecting into said hollow interior region, wherein said central portion of said interior divider defines a central opening and said outwardly-extending portion of said interior divider comprises a flange that is spaced from said interior surfaces of both said inner shell and said outer shell; and a foam core disposed in said hollow interior region, wherein said foam core is bonded to said interior surfaces of both said inner shell and said outer shell, and to at least a portion of said interior divider;

wherein at least one of said central portion and said outwardly-extending portion of said interior divider comprises a divider surface configured to divide said foam core into at least two core portions on respective opposite sides of said divider surface.

12. The panel of claim 11, further comprising a hinge for pivotably coupling said panel to an appliance, and a latch piece for releasably securing said panel in a closed position, wherein each of said hinge and said latch piece are coupled to said inner shell.

13. The panel of claim 12, further comprising a hinge cover disposed in a hinge region of said hollow interior region and securable to said hinge through said inner shell, wherein said inner shell, said outer shell, and said interior divider cooperate to prevent an uncured foam material of said foam core from entering into said hinge region of said hollow interior region.

14. A panel for appliances, said panel comprising:

an inner shell configured to cooperate with an outer shell to define a hollow interior region that encircles an open central region;

an intermediate close-out including a central portion encircling said open central region and at least one outwardly-extending portion extending into said hollow interior region;

a foam core disposed in said hollow interior region, wherein said foam core is bonded to said inner shell, said outer shell, and said intermediate close-out; and a inner window panel associated with said inner shell and an outer window panel associated with said outer shell, wherein said inner and outer window panels are disposed in said central region;

wherein said intermediate close-out cooperates with said inner and outer shells to divide said foam core into separate portions within said hollow interior region, and wherein said outwardly-extending portion of said intermediate close-out comprises at least one dividing arm that spans from an interior surface of said inner shell to an interior surface of said outer shell, and from said central portion to an interior perimeter surface of at least one of said inner and outer shells.

15. The panel of claim 14, wherein said intermediate close-out is unitarily formed with at least one of said inner shell, said outer shell, said inner window panel, and said outer window panel.

16. The panel of claim 15, wherein said intermediate close-out is unitarily formed with said inner shell and said inner window panel.

17. The panel of claim 14, wherein said at least one dividing arm comprises a first dividing arm and a second dividing arm, and wherein said first and second dividing arms are configured to prevent an uncured foam material of said foam core from entering into a portion of said hollow interior region that is defined between said first and second dividing arms and said inner and outer shells.

18. The panel of claim 14, further comprising a hinge and a hinge cover for pivotably coupling said panel to an appliance, wherein said hinge cover is disposed in a hinge region of said hollow interior region and is securable to said hinge through said inner shell, wherein said inner shell, said outer shell, and said intermediate close-out cooperate to prevent an uncured foam material of said foam core from entering into said hinge region.

19. A panel for appliances, said panel comprising:

an inner shell configured to cooperate with an outer shell to define a hollow interior region that encircles an open central region;

an intermediate close-out including a central portion encircling said open central region and at least one outwardly-extending portion extending into said hollow interior region;

a foam core disposed in said hollow interior region, wherein said foam core is bonded to said inner shell, said outer shell, and said intermediate close-out; and a inner window panel associated with said inner shell and an outer window panel associated with said outer shell, wherein said inner and outer window panels are disposed in said central region;

wherein said intermediate close-out cooperates with said inner and outer shells to divide said foam core into separate portions within said hollow interior region, and wherein said outwardly-extending portion of said intermediate close-out comprises a flange that is spaced from both said inner shell and said outer shell.

20. The panel of claim 19, further comprising a hinge and a hinge cover for pivotably coupling said panel to an appliance, wherein said hinge cover is disposed in a hinge region of said hollow interior region and is securable to said hinge through said inner shell, wherein said inner shell, said outer shell, and said intermediate close-out cooperate to prevent an uncured foam material of said foam core from entering into said hinge region.

* * * * *